US006463777B1

(12) United States Patent
de Curraize et al.

(10) Patent No.: US 6,463,777 B1
(45) Date of Patent: Oct. 15, 2002

(54) METHOD FOR THE CONTINUOUS PRODUCTION OF A METAL STRIP

(75) Inventors: Noël de Curraize, Montbrison; Francois Leroux, Senlis, both of (FR)

(73) Assignee: Vai Clecim, Nanterre cedex (FR)

( * ) Notice: Subject to any disclaimer, the term of this patent is extended or adjusted under 35 U.S.C. 154(b) by 0 days.

(21) Appl. No.: 09/720,491

(22) PCT Filed: Apr. 28, 2000

(86) PCT No.: PCT/FR00/01161

§ 371 (c)(1),
(2), (4) Date: May 25, 2001

(87) PCT Pub. No.: WO00/66287

PCT Pub. Date: Nov. 9, 2000

(30) Foreign Application Priority Data

Apr. 28, 1999 (FR) ..... 99 05393

(51) Int. Cl.[7] ..... B21B 15/00

(52) U.S. Cl. ..... 72/206; 72/8.6; 72/39; 72/203; 72/205; 72/365.2

(58) Field of Search ..... 72/8.6, 11.4, 39, 72/41, 201, 203, 205, 206, 365.2, 366.2; 148/645

(56) References Cited

U.S. PATENT DOCUMENTS

| | | | | | |
|---|---|---|---|---|---|
| 4,379,547 | A | * | 4/1983 | Shimbashi et al. | 266/103 |
| 5,709,759 | A | * | 1/1998 | Ljungers et al. | 148/645 |
| 5,771,731 | A | * | 6/1998 | Rohde et al. | 72/201 |
| 5,802,902 | A | * | 9/1998 | Rosenthal et al. | 72/201 |
| 6,062,055 | A | * | 5/2000 | Bobig et al. | 72/201 |
| 6,282,767 | B1 | * | 9/2001 | Borsi et al. | 72/201 |

FOREIGN PATENT DOCUMENTS

| | | |
|---|---|---|
| DE | 2043370 | 4/1971 |
| DE | 195 13 999 A | 10/1996 |
| EP | 0 706 840 A2 | 4/1996 |
| EP | 0 769 333 A1 | 4/1997 |
| FR | 2553312 | 4/1985 |
| JP | 63119913 | 5/1988 |
| JP | 0824908 | 1/1996 |

OTHER PUBLICATIONS

Patent Abstracts of Japan: Inventor: Sugano Satoshi; Applicant: Toshiba Corp., "Production of Cold Rolled Steel Sheet" Publication No. 60257906, Publication Date: Dec. 19, 1985.

Patent Abstracts of Japan: Inventor: Naganami Natsuko; Applicant: Ishikawajima Harima Heavy Ind Co. Ltd; "Roll Change Multi Roll Mill"; Publication No. 10175002; Publication Date: Jun. 30, 1998.

Patent Abstracts of Japan: Inventor: Suzuki Kataru; Applicant: Ishikawajima Harima Heavy Ind Co. Ltd; "Multistage Rolling Mill" Publication No. 63119913, Publication Date: May 25, 1988.

(List continued on next page.)

*Primary Examiner*—Ed Tolan
(74) *Attorney, Agent, or Firm*—Arent Fox Kintner Plotkin & Kahn

(57) ABSTRACT

The invention aims at a method of producing a metal strip on a continuous treatment line comprising a de-scaling station coupled with a cold rolling section.

Figure 1:
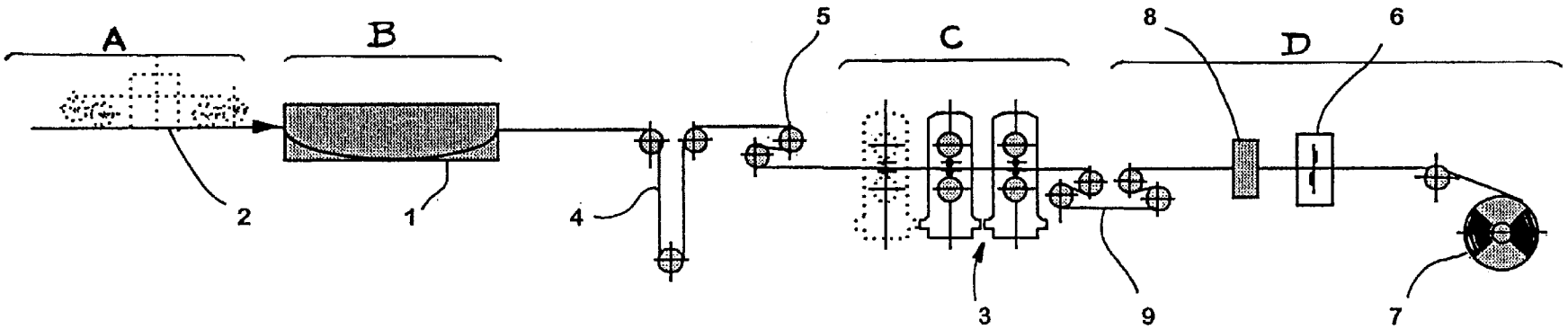

According to the invention, in order to adapt to a change in the production constraints, such as a spool change, the rolling speed is caused to vary on a very wide range down to less than 1 m/min and the cold rolling operation is done between working rolls the diameter of which is so small that, on said whole wide speed variation range, the rolling strength to be applied remains compatible with the product thickness adjustment possibilities, taking the characteristics thereof into account.

24 Claims, 2 Drawing Sheets

OTHER PUBLICATIONS

Patent Abstracts of Japan, vol. 1996, No. 5, Jan. 20, 1996; Inventor: Kaneyasu Shintaro; Applicant: Nisshin Steel Co. Ltd., "Rolling Method for Stainless Steel and High Alloy Steel Strip" Publication No. 08024908.

Patent Abstracts of Japan, Mar. 3, 1998; Inventor: Matsushita Satoru; Applicant: Sumitomo Metal Ind Ltd., "Method for Cold–Rolling Ferritic Stainless Steel Strip"; Publication No. 10058010.

"Le Decapage– Tandem Couple De Sainte– Agathe A Sollac Florane: Pointapres Dix Annees D'Exploitation" by Jouet J. Et Al., No. XP000765162; pp. 377–382.

* cited by examiner

METHOD FOR THE CONTINUOUS PRODUCTION OF A METAL STRIP

The present invention relates to a method of continuous production on a line of a metal strip such as a steel rolled metal sheet, from a heat formed strip.

It is generally known that producing metal products first requires the production of a coarse product by ingot casting or by continuous casting, a heat forging and/or heat rolling treatment and a cold treatment comprising several steps depending upon the metal nature, for example ferritic or austenitic steel, and upon the quality of the product to be produced.

Usually, the heat formed product is submitted, successively, to a de-scaling treatment for removing scales, to a cold rolling process until a desired thickness has been obtained, and, finally, to finishing treatments.

The cold rolling process is usually carried out in several successive passes, either in two opposite directions on a reversible train, or on several roll stands operating as a tandem.

It is known that, in a rolling mill, the product is driven between two working rolls the spacing of which is less than the rough thickness of the upstream product. A metal flow occurs which is friction driven in the gripping gap between the rolls up to an outlet section the thickness of which substantially corresponds to the spacing between the working rolls, with a progressive speed increase which corresponds to the metal preservation.

During a rolling process, the working rolls tend to be spaced apart one from another and the clearance between the opposite generators must therefore be maintained by applying, between the rolls, a clamping effort, often so-called rolling power.

The rolling power to be exerted in order to obtain a certain thickness reduction rate depends of course upon the diameter of the working rolls and upon the metal composition: common poorly alloyed low carbon steel, stainless steel, alloyed steel, as well as upon the features thereof, more particularly the yield point.

Under the action of the rolling power being applied between their ends, the rolls tend to be bent. Moreover, deformations and collapses of the different elements of the roll stand occur, in particular the columns supporting the clamping means.

Several means are available in a roll stand to compensate for the deformation of the rolls and the stand, in order to keep the thickness regularity and correct the flatness defects by modifying the stress distribution along the backing generators of the working rolls.

In normal operation, these correcting means make it possible to hold the strip qualities on the largest length of the spool, often referred to as "strip body". However, at the start of a new spool unwinding, the upstream end or "head" thereof must be inserted into the installation, on a sufficient length so as to allow for strip driving. Therefore, the new spool head may be welded onto the downstream head, or "tail", of the preceding spool. Similarly, at the device output, when the spool being wound has reached its maximum size, the strip has to be sheared so as to release the spool and secure the upstream end of the subsequent strip portion on the winding mandrel.

Reducing the unwinding speed cannot be therefore avoided, more particularly in the cold rolling stands,.such a speed even becoming nil if a single winding core is being used.

As a result, the strip qualities cannot be usually held on the spool head and tail, which must be eliminated.

Moreover, it is necessary, before cold rolling, to eliminate, as much as possible, the oxidation produced scales due to the previously undergone treatments and, to that effect, several known methods can be used, for example shot-blasting or chemical de-scaling, etc.

In the past, the various cold treatments were continuously carried out in separate sections, the product being wound into a spool at the end of each section in order to be transferred to the following section. Nevertheless, these batch processes have the disadvantage that they multiply the spool winding and unwinding processes and that they require intermediary storage steps leading to high costs, because of the indispensable handling devices and the necessary personnel.

Manufacturing processes have been developed for a few years, allowing to eliminate the spool winding at least for some intermediary steps, the spool successively running in at least two treatment sections located on a continuous line. Accumulators are mounted between the successive sections in order to make it possible for them to work at different instantaneous speeds. The spool running step may thereby be slowed down or even stopped in a section, for example in the case of a mishap or when changing spool, whereas the other sections keep on working.

In particular, coupling the de-scaling process with the cold rolling process makes it possible to reduce substantially the above-mentioned disadvantages.

On such a continuous line assembly, rolling is performed in a tandem rolling mill having normally four to five roll stands.

Such an assembly is described, for example, in "Décapage-tandem couplé de Sainte Agathe à Sollac-Florange", published in "La Revue de Métallurgie", March 1998.

Until now, the hot forming and treatment methods allowed to produce heat strip spools with a relatively high thickness. In order to obtain the usually required thickness, the thickness reduction rate to be performed was therefore large, generally in the range of 70% to 80% and up to 90% for some steel grades.

The rolling mills adapted to develop the necessary power are very expensive and usually the coupled line assemblies are therefore optimised favouring the tandem rolling mill working that is the bottleneck of the assembly.

More particularly, as just described, the rolling mill must at least slow down at the spool change and, if the running speed decreases, the friction coefficient increases, so does the rolling power to be applied between the working rolls to obtain the required thickness reduction. Moreover, the deformations and collapses within the roll stand increase as well. It has thus been observed that there is a boundary under which rolling cannot be performed with a thickness adjustment.

Usually, one therefore attempts to maintain a relatively high speed, in the order of 300 m/min, for example, so as not to enter a field where a slow speed would make it impossible to hold the thickness quality.

As the strip shearing cannot be avoided for the spool change, at the assembly outlet, it is necessary to minimise, as much as possible, the period of time needed for this operation. To that effect, strip shearing is usually carried out at a relatively high speed using a so-called "flying" shear and two successively actuated winding mandrels are used so that, during the time needed for unloading the spool wound on the first mandrel, the strip can be engaged and starts to wind on the second mandrel, immediately after the shearing step.

Under these conditions, the strip quality is only affected for a low value, 1% or a few %, and on a short distance, which may be limited to a few meters. Thus, the yield per 1000 kg of the assembly remains acceptable. Moreover, the external spool face serving as a wrapping thereof can anyway be more or less deteriorated when being handled and is therefore sacrificed.

However, to optimise the working of the rolling mill, it should be adapted to determine product types and the other sections of the coupled line, more particularly the de-scaling and finishing assemblies, must be provided accordingly.

That is why, until now, the strip producing assemblies on a continuous line were essentially provided for products having a very large capacity, in the order of 1 to 2 million tons a year, for example automotive bodywork sheets.

For special products requiring a more limited capacity, it would be more profitable to perform the rolling operation in successive passes, in one direction and in the opposite direction, on a reversible roll stand.

On the other hand, for hard or very thin products, for example in stainless steel, it is usually preferred to use a small roll rolling mill of the SENDZIMIR type.

It has been also contemplated, for the production of stainless steel strips, to manufacture coupled assemblies, on a continuous line, but, in this case, the various treatments should be performed under very accurate conditions so that the product has the desired properties.

In all cases, paradoxically, extremely expensive assemblies are therefore available, the working conditions of which are quite strict.

But technology constantly goes forward and, for example, the manufacturing and heat treatment methods have recently undergone large developments that should be considered.

Additionally, the clients' needs are changing and it can therefore be boring, even for producing conventional low carbon poorly alloyed steel sheets, to use very expensive assemblies being simultaneously specialized in a particular production type.

The object of this invention is therefore to overcome such inconvenience with a new production method, on a continuous line, for a rolled sheet, allowing to adapt very flexibly to a change in the production conditions, while holding the possibility in any cases to solve all the above-mentioned problems. In particular, the invention makes it possible to keep the thickness regularity, and in a general way, the sheet quality on a strip length at least of the same order as in the most performing present assemblies and even practically on the whole spool.

The invention therefore generally relates to the production of a metal strip from a heat produced product, by running the strip, on a continuous treatment line having, in one running direction of the strip, an inlet section, a de-scaling section for eliminating the calamine, an accumulating section, cold rolling means and an outlet section having a shearing element and winding means.

According to the invention, in order to adapt to a change in the operating constraints, more particularly a slackening of speed for the spool change, the rolling speed is caused to vary on a wide range from less than 1 m/min to more than 1000 m/min and the cold rolling operation is performed in maximum three passes between the working rolls the diameter of which is defined so that, on the whole speed variation range, the rolling power needed to maintain the thickness reduction rate at each pass remains compatible with the thickness adjustment and product flatness possibilities, taking the characteristics thereof into account.

The invention may exhibit advantages for all steel types but, in practice, it essentially applies to the production of conventional low carbon and/or poorly alloyed and/or low yield strength steel sheets.

In a particularly advantageous way, for cold rolling, working rolls are provided the diameter of which does not exceed 200 mm.

In practice, the cylinder diameter will be determined so that the rolling power needed at the lowest speeds does not exceed twice the rolling power at the highest speeds.

The invention specially relates to the production of sheets made of soft or poorly alloyed steel for which the rolling operation will be advantageously limited to two passes, taking the yield strength of the steel and the reduction rate to be obtained into account.

According to another preferred feature, in order to lubricate and to cool roll stands, an oil-in-water emulsion is used, the saponification index of which does not exceed 50.

The invention also relates to a continuous line assembly for industrial production of a steel sheet strip for carrying out the method, comprising successively:

a primary de-scaling section for eliminating calamine;

a continuous cold rolling section, an outlet section comprising a strip-shearing element for cutting and spooling and a strip-winding device.

In a particularly advantageous embodiment, the invention relates to the production of sheets of soft, low carbon and/or poorly alloyed steel and relates also to an assembly wherein the rolling section comprises three roll stands at most, the shearing element is of stationary type and the winding device comprises only one winding mandrel, such an assembly being particularly cost effective.

Preferably, the de-scaling section may be of the chemical or electrochemical type and may then comprise a "break-oxide" tensile planing device.

Advantageously, depending upon the applications and the steel shades, the de-scaling section may also comprise a shot blasting and/or an abrasion device.

According to an essential feature of the invention, the cold rolling process is done in roll stands provided with small diameter working rolls. To this effect, it will be particularly advantageous to use multi-roll stands with intermediary rolls arranged in clusters of the "cluster mill" type or roll stands the working rolls of which are associated to side backing rolls, in particular of the "Z-high" type.

The roll stands will be advantageously provided with a device for checking the strip flatness. For example, at least one backing roll will be of the deformable rotating jacket type.

In a particularly advantageous way, on a continuous line for implementing the invention, the cutting out point may be located at such a distance from the winding core that the strip length being developed up to the gripping gap of the last roll stand of the rolling mill is higher than 20 meters, the thickness regularity remaining secured in the portion constituting the strip body.

This way it is possible to provide, between the rolling mill and the shear, some secondary elements such as a tensioning device and/or oiling means for the strip.

But the method according to the invention may also be applied to lines the cutting out point of which is located at such a distance that the strip length being developed up to the gripping gap of the last roll stand of the rolling mill is less than 20 meters, the thickness tolerance being tighter in the portion constituting the strip ends.

According to another very advantageous feature, a continuous line assembly according to the invention may also be used to treat heat produced strips which only require a low or no thickness reduction, the cold rolling last pass simply performing a finishing treatment of the "skin-pass" type. The rolling stands will then advantageously be quarto rolling stands of the "Z-high" type wherein each assembly formed with a working roll, an intermediary roll and of the side backing rolls, is an insert that can easily be replaced by a working roll having a large diameter so as to make a skin-pass working roll stand of the quarto type.

In that case, the large diameter last rolling stand may advantageously be used to impart to the sheet quite a significant roughness, for example of at least 0.4 micrometers so as to enhance the adherence of a protective coating.

Figure 2:
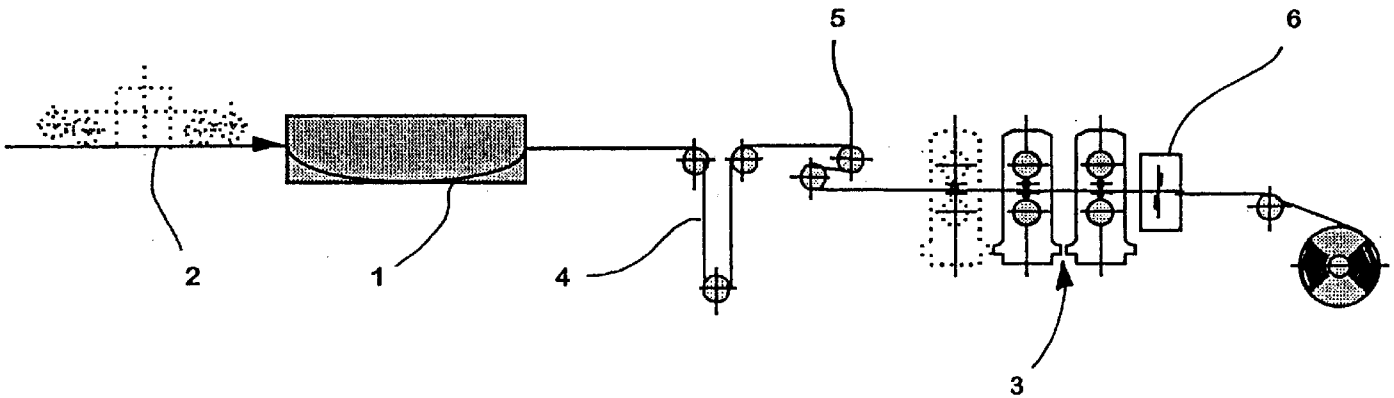
Figure 3:
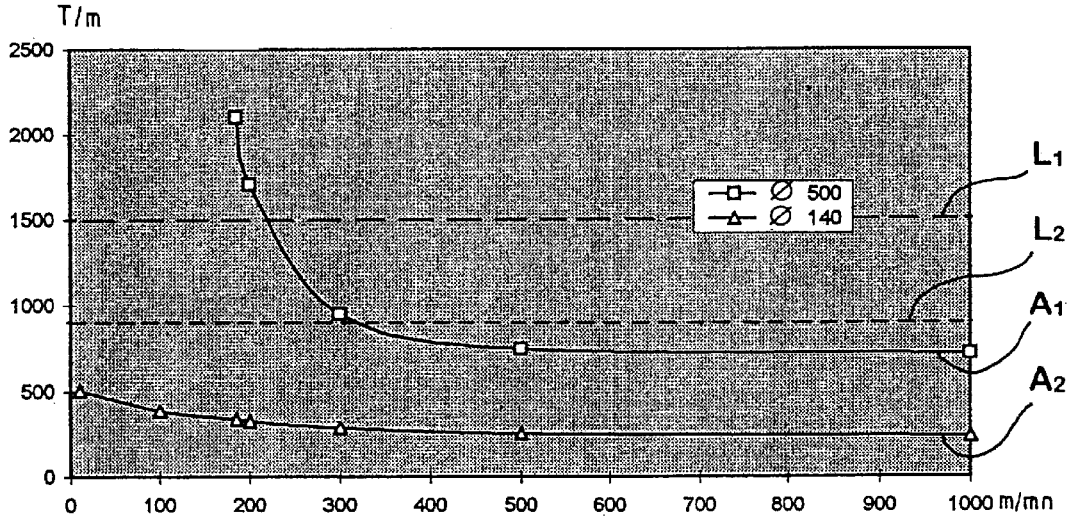
Figure 4:
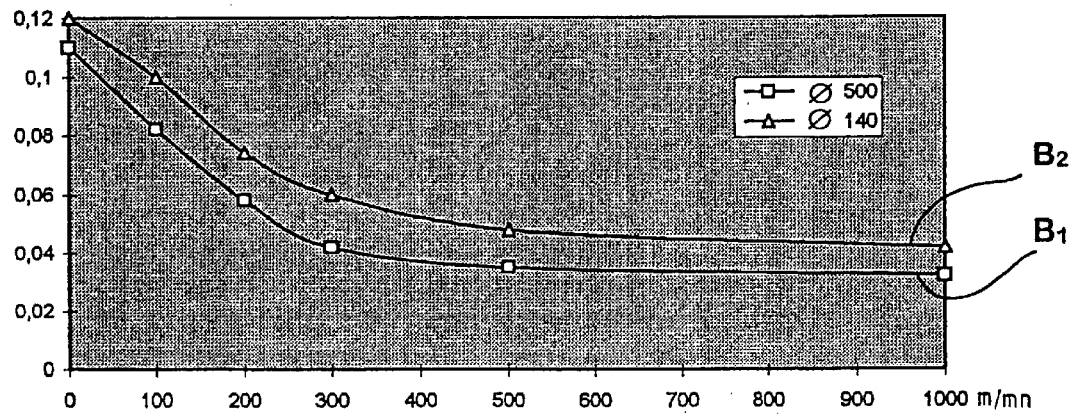

But the invention will be more easily understood with the following detailed description with reference to the accompanying drawings wherein:

FIG. 1 schematically illustrates a sheet producing coupled line for implementing the method according to the invention, FIG. 2 schematically illustrates another configuration of a coupled line according to the invention, FIG. 3 is a representative diagram for the rolling power variation as a function of the speed for working roll large diameters and for small diameters, and FIG. 4 is a diagram of the friction coefficient variation with a lubricating agent adapted to the two cases in FIG. 3.

On FIG. 1, a coupled line is schematically shown comprising an inlet section A, a de-scaling section B, a rolling section C and an outlet section D.

The inlet section A has not been shown in details and comprises a spool unwinding core and a welding equipment.

The heat strip coming from a (non shown) spool unwinds from left to right passing first through a de-scaling station 1 adapted to eliminate scales present on the heat formed sheet. This unit may be of a known type: chemical de-scaling, scrub de-scaling, shot blasting, abrasion or also a combination of several techniques. II may be advantageously preceded by a tensile planing device 2, the function of which is to cause the scales to be cracked so as to facilitate the action of a chemical de-scaling. The de-scaling station 2 is particularly adapted to the treatment of a high yearly tonnage of strip the thickness of which may be substantially lower than in the coupled assemblies known until now, for example, lower than one millimetre. The de-scaling line 1 will be therefore provided to work at a high speed which will be kept substantially constant, with no standstills or even significant slackenings in order to adapt to the operation of the downstream rolling assembly 3.

The rolling section 3 is connected with the de-scaling section 1 by means of a strip accumulating device 4 associated with a tensioning block 5. This arrangement allows to slow down or to stop the rolling mill without disturbing the de-scaling action. The speed in the de-scaling section depends upon the de-scaling method and upon the characteristics of the heat formed sheet steel. The accumulator has the necessary capacity to hold the scaling action at its optimal speed when the rolling speed is different from that of the scaling, the tensioning block performing a separate tension control in both sections.

It is generally known that the cold tandem rolling mills comprise a succession of stands arranged one after the other on the path of the strip the thickness of which is progressively reduced. The strip is held perfectly tensioned in the space between two successive stands or inter-stand space, through adjusting the tension within the strip at a predetermined value depending on the properties of the product being rolled. More particularly, in each of the roll stands, such rolling conditions are being held so as to avoid reaching tension levels likely to lead to a strip breaking.

The adjustment of the cold tandem train is carried out so as to obtain a perfectly constant outlet thickness in the strip, adjusting more particularly the rolling effort applied by the clamping device as well as the speeds of the first and the last roll stands. The speeds of the intermediary roll stands, if any, may be derived from such conditions, since they are prescribed by the preservation law of the metal mass passing through the rolling mill stands.

As usual, the roll stands comprise adjustment means for the clamping effort being applied during rolling between the rolling mill rolls allowing in particular to compensate for the deformations of the roll stand under the rolling effort, in order to held the product thickness substantially constant when leaving the roll stand. Said clamping devices usually comprise hydraulic jacks bearing, in a quarto rolling mill, onto the ends of a backing roll with a large diameter.

Advantageously, at least one stand of the rolling mill 3 is provided with a device for correcting the flatness defaults through modification of the constraint distribution along the backing generator. Such an arrangement, using a rotating jacket backing roll, has been disclosed, for example, in FR-A-2,553,312 and FR-A-2,572,313 of the Applicant.

As already indicated, the object of the invention aims at adapting to various needs, by acting very flexibly on the working conditions of the assembly, more particularly on the rolling speed, while keeping the possibility to maintain the quality of the rolled strip on the largest length possible.

To reach this goal, the respective influences of various factors which are involved in the rolling process have been accurately studied.

As already known, a major parameter to obtain, in determined conditions, the required thickness reduction is the diameter of the working rolls.

Until now, it seemed normal to use, for cold rolling, working rolls with quite a large diameter in the order of 500 mm.

In fact, the metal being friction driven along the circular faces of the working rolls delimiting the rolling gripping gap, a large diameter with respect to the thickness reduction to be obtained allows to reduce the friction angle and therefore makes strip driving easier.

Additionally, a large diameter allows to increase the wear range. As already known, in fact, the rolls wear by contact with the metal and must be periodically rectified, then replaced when the diameter reduction becomes excessive. A larger diameter allows for a relatively more significant wear range.

But one should also have in mind that it is necessary to lubricate and to cool the rolls which become overheated during the rolling process. Said cooling step is done from the circumference and is therefore more efficient with a larger diameter.

The cooling step is usually done through sprinkling a heat-carrying fluid, but the friction coefficient between the rolls and the product, which is also involved in the rolling process, depends upon the lubricating capacity of this fluid.

It has been found that the maximum possible thickness reduction during a rolling pass can be written according to the following formula:

$$\Delta e<2(\mu+(T_e-T_s)/2F)^2D \quad (1)$$

wherein $\mu$ means the friction coefficient, F the rolling effort, $T_s$ and $T_e$ the outlet and inlet tensions of the roll stand and D the working roll diameter.

Such formula (1) shows in particular, that the thickness reduction not only depends on the roll diameter, but also on the friction coefficient and the rolling power.

Such various parameters, which have beside a mutual influence, may be determined so as to perform the rolling process in the best possible conditions, while maintaining the thickness and the flatness for a normal running speed corresponding to the production capacity of the assembly.

However, as already seen above, mishaps or, simply, the need to change a spool, require periodically significant speed variations. Thus, the influence of the above-mentioned parameters on the rolling process has been studied, depending upon the variations in the running speed.

The diagrams in FIGS. 3 and 4 show, for a common steel and according to the working roll diameter, the variations versus the running speed indicated in abscissa, respectively, of the rolling power to be applied and of the friction coefficient. By way of an example, the diagrams have been illustrated for a soft steel with a relatively low yield strength in the order of 25 kg/mm$^2$.

Curves A1 and B1 correspond to a rolling operation performed between working rolls having, as usual, quite a large diameter in the order of 500 mm.

Curve Al shows, as already indicated, that the rolling power, which varies quite a little for high speeds, rapidly increases from a limit speed which, for a roll diameter of 500 mm and for the steel being considered, is in the order of 400 m/min.

For this reason, it is usually considered as preferred, in the conventional assemblies, not to reduce the rolling speed under 300 m/min, since from this limit the rolling power increases so much that the rolling operation may become impossible as the thickness adjustment cannot anyway any longer be ensured. In the case illustrated in FIG. 3, a rolling power of 1500 tonnes per meter of sheet width, which is often considered as the L1 limit not to be exceeded, is reached for a speed of 200 m/min approximately.

Until now, such conditions seemed normal for a profitable operation of the rolling means. The Applicant has however become aware that, due to the very high productivity of the coupled lines and the quantities usually ordered, the tonnages to be produced for each product type were in practice very reduced with respect to the production capacity and that, in contrast with what was admitted previously, it could be more advantageous to favour the assembly flexibility in order to face the various needs while accepting inconvenience which can anyway be attenuated.

Now, FIG. 3 shows that, for a common steel with a low yield strength, there is a very large difference in the variation of the rolling power to be applied, between curve Al corresponding to a 500 mm diameter and curve A2 corresponding to a 140 mm diameter. For a 500 mm diameter, if the rolling speed is reduced, the rolling power effectively increases exponentially from 400 m/min approximately. On the contrary, curve A2 shows that, for a 140 mm diameter for example, the rolling power varies relatively little, when the rolling speed is decreased from 300 m/min approximately and then only increases very progressively to reach 500 T/m at a near zero speed. Such a value thus remains very inferior to the L2 limit of the acceptable rolling power which, for the metal being considered and for a 140 mm roll diameter, is in the order of 900 T/m.

It is thereby possible, even at a very low speed, still to ensure the thickness and flatness adjustment for maintaining the sheet quality.

Thus, while it seemed natural until now to provide rolling mills with rolls having quite a large diameter, it seems that using smaller working rolls allows to increase considerably the variation range of the rolling speed, which could even become practically zero.

However, the friction coefficient varies substantially on the same way as the rolling power.

Curve B1 in FIG. 4, plotted for a 500 mm roll diameter, effectively shows that, if the speed is reduced from a normal rolling speed of 1000 m/min, for example, the friction coefficient first varies very little up to a speed in the order of 400 m/min, but increases then below this speed.

Moreover, the above-mentioned formula (1) shows that, if the roll diameter decreases, the friction coefficient should be increased in order to ensure the thickness reduction.

That is why, according to another feature of the invention, it is interesting to use for the cooling step a fluid having a lubricating power lower than usual so as to keep a relatively high friction coefficient to obtain the required reduction level.

The composition of the heat-bearing and lubricating fluid will therefore be determined so as to combine the required value of the friction coefficient and the necessary heat elimination.

Other means also allow to improve the operation of a line according to the invention, while reducing the inconvenience associated with the use of small diameter rolls. For example, the tension speed applied in the tandem rolling mill can be acted upon.

However, in a flexible line according to the invention, the equipment configuration and the speed required for the production do not allow to get high tension speeds.

II seems therefore preferable to act on the friction coefficient in the way that has just been described in order to avoid that too low a friction coefficient for a given reduction would lead to a driving refusal for the sheet in the gripping gap and to a roll stand slipping, due to the diameter selected for the working rolls.

In particularly, it has been found that one could advantageously use as a lubricating agent an oil-in-water emulsion, the saponification index of which does not exceed 50.

On FIG. 4, curve B2 represents, with such a lubricating agent and for a 140 mm diameter, the friction coefficient variations versus the rolling speed. It appears in that case that the friction coefficient remains, in the whole speed range, higher than the one usually obtained with a 500 mm diameter.

When adapting the lubricating agent quality, the working rolls may be given a sufficiently small diameter so that, in the whole speed range, the rolling power remains less than the admitted limit. It becomes thereby possible to reduce the speed with no fear of a driving refusal and while keeping the thickness adjustment possibilities.

It has been found that, in the method according to the invention, the use in the roll stands of small diameter rolls, for example less than 200 mm, with an adapted lubricating agent, allows to cause the rolling speed to be varied in a very wide range from high values in the order of 1000 m/min down to the lowest values, even to zero speed, while limiting the rolling effort necessary for the required reduction to a level inferior to limit L2. Thus, this allows to hold tight thickness tolerances across the full length of the strips, body and ends being included and whatever the speed at which they have been rolled is.

The method according to the invention thus allows to produce, from a heat formed steel strip, a de-scaled and cold rolled strip with an improved thickness regularity in an extended speed range, particularly in the range of low and very low rolling speeds.

Obviously, smaller diameter working rolls have, compared to larger rolls, some inconvenience and that is why, until now, small roll stands with small rolls of the SEND- ZIMIR type were essentially used in a reversible rolling operation and for special and hard steels, in particularly stainless steels.

It has however been found that, even for common steels with a low or mean yield strength, the inconvenience of the roll stands with small rolls, specially their investment and maintenance cost, can be compensated by the economical advantages resulting from the use of a flexible line.

For example, if small diameter rolls have a more reduced wear range, they can however be produced in a tougher material, for example quick or sintered steel.

On the other hand, it is known that the working rolls are subjected to a bending effort in the product running longitudinal direction, which is perpendicular to their axis, and that large diameter working rolls withstand better such bending. However, roll stands have been developed wherein small diameter working rolls are associated with side backing means allowing them to withstand the bending in the longitudinal direction.

Such rolling mills, so-called of "Z-high" or "cluster-mill" type, are normally more expensive than the conventional rolling mills and were mainly used up to now for hard steels, for example high carbon and/or stainless steels.

It has however been thought that, within the scope of the invention, using rolling mills with small rolls could be profitable, even for common steels, because of the huge economical advantage offered by the line flexibility.

In fact, as already indicated, the continuous lines produced until now, in which the de-scaling station is coupled with a tandem rolling mill having four or five roll stands, are only profitable if they work at high speed, for very large capacities and to achieve a high reduction rate up to 80% or 90%.

However, there are products which can be produced straight from the heat formed strip with no thickness reduction. In that case, the strip is simply subjected to a de-scaling step possibly followed with a "skin-pass" rolling operation and is ultimately protected by sprinkling oil. Such products are generally produced in specific facilities, the rolling operation being done, if needed, in a separate section. If a coupled line is to be used, a switching should then be provided downstream the de-scaling section in order to direct the strip towards a "skin-pass" rolling mill, an oiling station and a winding core, the tandem rolling mill being not used in that case.

The invention thus mainly applies to the common steel strip manufacture which only require a low or nil reduction rate and which, until now, were made in a batch process, as the usual lines are not profitable in that case.

More specifically, the invention allows to take profit of the advances achieved in the heat forming and treatment lines, especially through continuous casting of a thin strip, which allow to obtain hot strips having a far much reduced thickness than previously.

In the past, the hot strips were indeed produced at a relatively large thickness, for example, 2 to 6 mm. Nevertheless, more recently, the technique development has allowed to reduce progressively this thickness down to 1.2 mm and it can be even contemplated to have available hot strips with a much lower thickness, down to 1 mm, for example.

Thus, for common steels with a mean yield strength, for example of 25 kg/mm$^2$ and requiring a reduction rate in the order of 50%, the rolling section may only comprise two or three small diameter roll stands and, in such a case, using roll stands of the "Z-high" type becomes profitable.

Similarly, it is possible, despite the cost increase, to provide the roll stands with sophisticated means for adjusting the thickness, for example, using a deformable rotating jacket roll.

On the other hand, the rolling mill contribution to the global cost of an assembly according to the invention decreases compared to the other line sections. In fact, while in the coupled lines known up to now, a considerable rolling power was necessary in order to achieve the desired thickness reduction rate, it can now be contemplated to reduce this rolling power and, consequently, the rolling assembly cost, when the thickness reduction rate to be achieved does not exceed 50%.

An industrial line according to the invention comprises at the outlet a winding device 7 preceded by a strip cutting out device 6 for producing readily conveyable spools.

Just before cutting, the speed should be reduced and the downstream end of the wound strip is therefore beyond tolerance. After cutting, the upstream end of the next part of the strip should be wound several turns on the winding mandrel, before going back to a speed and under a traction allowing a thickness adjustment.

That is why, as indicated above, in a rolled sheet spool, a strip body covering most of the length is usually distinguished for which it has been possible to maintain the quality in acceptable tolerances, and two ends the length of which cannot be reduced below a particular limit, for example 20 m, for which the thickness tolerance cannot be maintained the same way.

The method according to the invention makes it possible to improve the thickness tolerance even at very low rolling speeds, as well as on the rolled length outside tension during restart. It is therefore possible, without increasing the thousand putting rate, to contemplate new coupled line configurations wherein, in particular, the last roll stand could be located at a relatively large distance from the winding core.

For example, in the configuration shown on FIG. 1, between the rolling assembly outlet 3 and the winding core 7, a lubricating device 8 has been mounted, which is adapted to give some protection against corrosion to the finished product as well as a powerful tensioning block 9 allowing, on the one hand, to draw the strip to release it from the de-scaling step, even in the absence of rolling, and, on the other hand, to maintain a tension in the strip when this latter is being cut to finish a spool. This further improves keeping tight thickness tolerances while avoiding tension variations in the gripping gap of the last roll stand.

Compared to the previously known assemblies, which only comprised a ingle de-scaling station with optionally a "skin-pass" and a lubricating device, an assembly according to the invention thus allows to reach, in a continuous way, a mean thickness reduction and, consequently, to increase the production range without considerably increasing the global cost.

As indicated, at least one roll stand 3 is advantageously of the "Z-high" type. Now, it can be converted by giving to each assembly formed with a small diameter roll, an intermediary roll and side backing rolls, the aspect of an "insert" which can be replaced with a larger diameter roll, for example, larger than 500 mm, so as to produce a quarto type stand able to achieve a skin-pass treatment between the working rolls.

Another advantage of a coupled line according to the invention will be therefore to be able to use part of the production time to produce spools the sheet thickness of which is directly the one of the heat formed strip and which does not require cold thickness reduction, but only a de-scaling step and a finishing rolling pass of the "skin-pass" type.

The possibilities of an existing line can thereby be easily increased.

The arrangement of an industrial line according to FIG. 1 requires a huge space between the last roll stand and the strip cutting out point for separation in the shearing device 6 and cutting is done at a very low speed, sometimes at standstill. The method according to the invention however makes it possible to guarantee the thickness tolerance on this part of the strip which is therefore integral with the strip body, while it would largely be out of tolerance with a classical method on this part of the spool. Thus, this allows to sell it with a guarantee, which makes it possible to avoid re-unwinding operations and expensive checks.

However, the method according to the invention also enables, without departing from the protection scope as defined in the claims, to contemplate other configurations in a view to adapt to customer's needs or, for example, to an existing assembly.

For example, insofar a low or even nil thickness reduction is achieved in the last roll stand, it may be interesting to use it with a view to imparting to the product some roughness compatible with a protection treatment by a surface coating, including an electroplating treatment. Thus, whereas some roughness is usually obtained in the order of 0.4 micrometer to 0.5 micrometer, for example, for automotive sheets, it is necessary, for other applications, such as in the building industry, to give some additional roughness to the sheet, in the order of 1 micrometer to 2 micrometers, for example.

The invention enables to meet such a requirement in a flexible way.

In an assembly according to the invention, instead of performing a "skin-pass" treatment, the last roll stand could be provided with working rolls having a conventional diameter and a roughness in the range between 3 et 4 micrometers, enabling, considering the transfer rate for example of 40%, to give the required roughness to the resulting sheet.

Moreover, a more compact line could also be contemplated which does not include all the above mentioned finishing devices. The line schematically illustrated on FIG. 2 thus includes a de-scaling section 1 and a rolling section 3 between which a strip 4 accumulating device 2 and a tension checking block 5 are arranged. A break-oxide tensile planing device can also be arranged upstream the de-scaling section 1. The outlet of such a line then simply includes the shearing device 6 for separation followed by the winding device 7.

Upon shearing, the strip in the gripping gap is out of tension which, in the conventional methods, would generate a sudden thickness variation. The distance between the separating point and the gripping gap in the last roll stand is short and usually less than 20 meters in rolled strip developed length. Thus, this area is located in the strip ends the thickness tolerance of which is traditionally less tight than that of the strip body. The use of a method according to the invention however enables to enhance such thickness tolerance during the slackening and up to standstill, as well as on the rolled length outside tension during restarting, so that the strip ends suit to the thickness tolerance established by the customer.

The reference numerals inserted after the technical features as mentioned in the claims are only intended to facilitate their understanding and by no means limit their scope.

What is claimed is:

1. A method of producing a metal strip from a heat formed strip, by the continuous running thereof, in a treatment line comprising, successively, in one running direction, scale eliminating means, accumulating means, cold rolling means, a shearing element and winding means, said method comprising the steps of:

varying a rolling speed of said metal strip, in order to adapt to a change in operating constraints, over a very wide range from less than 1 in/mm to more than 1000 in/mm;

cold rolling said metal strip in a maximum of three passes; and determining a working roll diameter so that a rolling power needed to maintain a specified thickness reduction rate at each pass remains compatible, over the whole speed variation range, with the specified thickness adjustment and a desired product flatness, taking the characteristics of said metal strip into account.

2. A method according to claim 1, characterized in that, for cold rolling, working rolls are used, the diameter of which does not exceed 200 mm.

3. A method according to any one of claims 1 or 2, characterized in that the diameter of the working rolls is determined so that the rolling power required at the lowest speeds is, at the most, in the order of twice the rolling power at the highest speeds.

4. A method according to claim 1, characterized in that, in order to achieve lubrication and cooling of the roll stands, an oil-in-water emulsion is used, the saponification index of which does not exceed 50.

5. A method according to claim 1, characterized in that the thickness adjustment and the flatness correction remain ensured in the case the running speed and the strip tension are reduced and until a return back to normal speed and tension.

6. A method according to claim 1, characterized in that the strip is made of a common low carbon and/or poorly alloyed and/or low yield strength steel.

7. A method according to claim 6, characterized in that the strip is subjected to maximum two thickness reduction passes, the global reduction rate not exceeding 50%.

8. A method according to claim 6, characterized in that, in the last cold rolling pass, the strip is subjected to a rolling operation of the "skin-pass" type, achieving a minimum thickness reduction rate.

9. A method according to claim 8, characterized in that, during the last cold rolling pass, a roughness is imparted to the strip, which is compatible with a surface coating protective treatment.

10. A method according to any one of claims 6 to 9, characterized in that the last rolling pass is performed between two working rolls having a diameter of at least 300 mm.

11. A method according to claim 9, characterized in that the strip is subjected to a single thickness reduction pass and to a rolling pass of the "skin-pass" type achieving a minimum thickness reduction rate.

12. A method according claim 1, characterized in that the thickness regularity is maintained over the whole speed variation range so that each wound spool comprises a strip body with the required thickness and two ends the length of which may be less than the distance between the last roll stand and the shearing element.

13. A continuous production line for a steel sheet strip made of a low carbon and/or poorly alloyed and/or yield strength steel for carrying out the method according to any one of claims 1–9, comprising successively, in one strip running direction, an inlet section with a spool unwinding device and a welding device, a de-scaling section, a cold rolling section, a tensioning device provided at the rolling section outlet for maintaining the tension therein, a strip lubricating device and an outlet section with a shearing device and a winding device.

14. A continuous industrial line for producing a steel sheet strip for carrying out the method according to any one of the preceding claims, comprising successively, in one strip running direction:

an inlet section comprising a running device for a heat rolled spool and a welding device;

a de-scaling section for eliminating scales;

a continuous cold rolling section comprising at the most three roll stands provided with working rolls with a diameter of at the most 200 mm; and an outlet section having a strip shearing element for separating and spooling and a strip winding device.

15. A production line according to claim 14, characterized in that the de-scaling station is of the chemical or electro-chemical type.

16. A production line according to claim 15, characterized in that the de-scaling station additionally comprises a "break-oxide" tensile planing device.

17. A production line according to any one of claims 14 or 15, characterized in that the de-scaling station additionally comprises a shot-blasting and/or an abrasion device.

18. A production line according to claim 14, characterized in that at least one of the cold rolling roll stands is of the "cluster mill" type.

19. A production line according to claim 14, characterized in that at least one of the cold rolling roll stands is of the "Z-high" type.

20. A production line according to claim 19, characterized in that the "Z-high" roll stand includes at least one backing roll of the rotating jacket type radially bearing on a set of adjustable shoes.

21. A production line according to any one of claims 14, 15, 16, 18 or 19, characterized in that the shearing element is spaced away from the last cold rolling stand on a distance corresponding to a strip developed length of at least 20 meters.

22. A production line according to any one of claims 14, 15, 16, 18 or 19, characterized in that the shearing element is spaced away from the last cold rolling stand on a distance corresponding to a strip developed length of less than 20 meters.

23. A production line according to claim 18, characterized in that at least one roll stand is of the type comprising a group of rolls subject to be replaced with working rolls having a diameter of at least 500 mm to perform a rolling pass with a very low thickness reduction.

24. A production line according to claim 18, characterized in that at least one roll stand is of the "Z-high" type, wherein each small diameter working roll is mounted in an insert subject to be replaced with a working roll having a diameter of at least 300 mm to perform a rolling pass of a very low thickness reduction type.

* * * * *